US006941089B2

(12) United States Patent
Rivera et al.

(10) Patent No.: US 6,941,089 B2
(45) Date of Patent: Sep. 6, 2005

(54) HEATING SYSTEM FOR A DEVELOPER HOUSING

(75) Inventors: Armando J. Rivera, Webster, NY (US); Ali R. Dergham, Rochester, NY (US); Todd K. Preston, Rochester, NY (US); William H. Wayman, Ontario, NY (US); Lisa D. Mantilla, Penfield, NY (US); Francesco Zirilli, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 53 days.

(21) Appl. No.: 10/689,131

(22) Filed: Oct. 20, 2003

(65) Prior Publication Data

US 2005/0084273 A1 Apr. 21, 2005

(51) Int. Cl.[7] ..... G03G 21/20; G03G 15/00; G03G 15/08

(52) U.S. Cl. ..... 399/94; 399/44; 399/92; 399/253

(58) Field of Search ..... 399/44, 53, 91, 399/92, 93, 94, 97, 222, 253

(56) References Cited

U.S. PATENT DOCUMENTS 4,570,572 A * 2/1986 Robinson et al. ..... 399/523
5,481,339 A * 1/1996 De Cock et al. ..... 399/93
5,530,523 A * 6/1996 Kawabata ..... 399/44
5,701,550 A * 12/1997 Lofftus et al. ..... 399/44
5,890,033 A * 3/1999 Parker ..... 399/94
6,185,382 B1 * 2/2001 Knott et al. ..... 399/44
6,377,769 B2 * 4/2002 Kakimoto ..... 399/92 X
6,400,915 B2 * 6/2002 Nukada ..... 399/94
6,473,573 B2 * 10/2002 Izumi et al. ..... 399/44
6,771,916 B2 * 8/2004 Hoffman et al. ..... 399/92
6,785,490 B2 * 8/2004 Tsukamoto et al. ..... 399/94

OTHER PUBLICATIONS

Copending U.S. Appl. No. 10/689223, filed Oct. 20, 2003, entitled "Heating System For A Developer Housing," by Jonathan Hunter et al.

* cited by examiner

*Primary Examiner*—Sandra L. Brase
(74) *Attorney, Agent, or Firm*—Lloyd F. Bean, II

(57) ABSTRACT

An apparatus for developing a latent image recorded on a movable imaging surface, including: a reservoir for storing a supply of developer material including toner particles, said reservoir including a developer material mixing and transport area; a donor member being arranged to receive toner particles from said reservoir and to deliver toner particles to the image surface at locations spaced apart from each other in the direction of movement of the imaging surface thereby to develop the latent image thereon; and a climate system, associated with said reservoir, for maintaining said supply of developer material at a predefined temperature, said climate system includes a cooling element for supplying air to said developer material mixing and transport area, and a heating element positioned in said developer material mixing and transport area, said heating element includes a first heat unit associated with heating an inboard area of said developer material mixing and transport area and a second heat unit associated with heating an outboard area of said developer material mixing and transport area.

16 Claims, 5 Drawing Sheets

HEATING SYSTEM FOR A DEVELOPER HOUSING

Reference is made to commonly-assigned co-pending U.S. patent application Ser. No. 10/689,223, filed herewith, entitled "Heating System For A Developer Housing," by Jonathan Hunter et al., the disclosure of which is incorporated herein.

This invention relates to an apparatus for maintaining the environment of developer material in a developer housing at a predefined set point.

Generally, the process of electrophotographic printing includes charging a photoconductive member to a substantially uniform potential to sensitize the photoconductive surface thereof. The charged portion of the photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image, forming a toner powder image on the photoconductive surface. The toner powder image is subsequently transferred to a copy sheet. Finally, the toner powder image is heated to permanently fuse it to the copy sheet in image configuration.

The electrophotographic marking process given above can be modified to produce color images. One color electrophotographic marking process, called image-on-image (IOI) processing, superimposes toner powder images of different color toners onto a photoreceptor prior to the transfer of the composite toner powder image onto a substrate. While the IOI process provides certain benefits, such as a compact architecture, there are several challenges to its successful implementation. For instance, the viability of printing system concepts, such as IOI processing, require development systems that do not interact with a previously toned image. Since several known development systems, such as conventional magnetic brush development and jumping single-component development, interact with the image on a receiver, a previously toned image will be scavenged by subsequent development if interacting development systems are used. Thus, for the IOI process, there is a need for scavengeless or noninteractive development systems.

Hybrid scavengeless development technology develops toner via a conventional magnetic brush onto the surface of a donor roll and a plurality of electrode wires are closely spaced from the toned donor roll in a development zone. An AC voltage is applied to the wires to generate a toner cloud in the development zone. The donor roll generally consists of a conductive core covered with a thin (50–200 microns) partially conductive layer. The donor roll is held at an electrical potential difference relative to the conductive core to produce the field necessary for toner development. The toner layer on the donor roll is then disturbed by electric fields from a wire or set of wires to produce and sustain an agitated cloud of toner particles. Typical AC voltages of the wires relative to the donor roll are 700–900 Vpp at frequencies of 5–15 kHz. These AC signals are often square waves, rather than pure sinusoidal waves. Toner from the cloud is then developed onto a nearby photoreceptor by fields created by a latent image.

A problem with developer systems is that when the temperature of a material is not in control results in increase contamination; donor roll filming, particles forming on electrode wires, material migration through a xerographic cavity, low image density, and poor/changing material transfer characteristics.

There is provided an apparatus for developing a latent image recorded on a movable imaging surface, including: a reservoir for storing a supply of developer material including toner particles, said reservoir including a developer material mixing and transport area; a donor member being arranged to receive toner particles from said reservoir and to deliver toner particles to the image surface at locations spaced apart from each other in the direction of movement of the imaging surface thereby to develop the latent image thereon; and a climate system, associated with said reservoir, for maintaining said supply of developer material at a predefined temperature, said climate system includes a cooling element for supplying air to said developer material mixing and transport area, and a heating element positioned in said developer material mixing and transport area, said heating element includes a first heat unit associated with heating an inboard area of said developer material mixing and transport area and a second heat unit associated with heating an outboard area of said developer material mixing and transport area.

There is also provided a xerographic printer including an environmental enclosure having xerographic stations enclosed therein selected from the group of: an imaging member, imaging station for recording an image on the imaging member, a development station for developing station for developing the image on the imaging member, and a transfer station for transferring the developed image to a substrate, comprising: an environmental climate unit connected to the environmental enclosure for maintaining xerographic stations therein at a predefined temperature; and wherein said development station includes: a reservoir for storing a supply of developer material including toner particles, said reservoir including a developer material mixing and transport area; a donor member being arranged to receive toner particles from said reservoir and to deliver toner particles to the image surface at locations spaced apart from each other in the direction of movement of the imaging surface thereby to develop the latent image thereon; and a climate system, associated with said reservoir, for maintaining said supply of developer material at a second predefined temperature, said climate system includes a cooling element for supplying air to said developer material mixing and transport area, and a heating element positioned in said developer material mixing and transport area, said heating element includes a first heat unit associated with heating an inboard area of said developer material mixing and transport area and a second heat unit associated with heating an outboard area of said developer material mixing and transport area.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Figure 1:
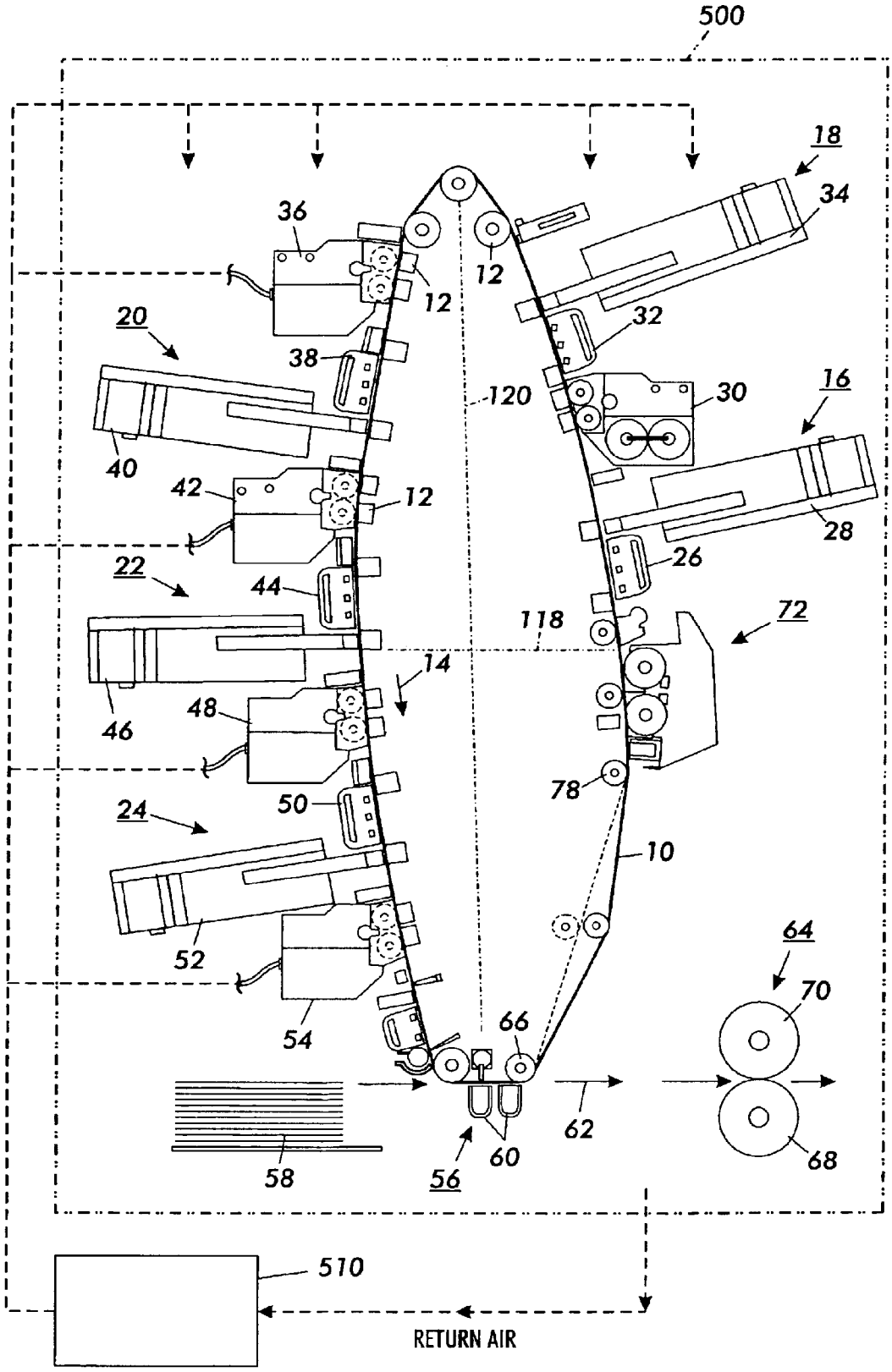
FIG. 1 is a printing machine in which the present invention is incorporated.

Referring now to the drawings, there is shown a single pass multi-color printing machine in FIG. 1. This printing machine employs the following components: a photoconductive belt 10, supported by a plurality of rollers or bars, 12. Photoconductive belt 10 is arranged in a vertical orientation. Photoconductive belt 10 advances in the direction of arrow 14 to move successive portions of the external surface of photoconductive belt 10 sequentially beneath the various processing stations disposed about the path of movement thereof. The photoconductive belt 12 has a major axis 120 and a minor axis 118. The major and minor axes 118 and 120 are perpendicular to one another. Photoconductive belt 10 is elliptically shaped. The major axis 120 is substantially parallel to the gravitational vector and arranged in a substantially vertical orientation. The minor axis 118 is substantially perpendicular to the gravitational vector and arranged in a substantially horizontal direction. The printing machine architecture includes five image recording stations indicated generally by the reference numerals 16, 18, 20, 22, and 24, respectively. Initially, photoconductive belt 10 passes through image recording station 16. Image recording station 16 includes a charging device and an exposure device. The charging device includes a corona generator 26 that charges the exterior surface of photoconductive belt 10 to a relatively high, substantially uniform potential. After the exterior surface of photoconductive belt 10 is charged, the charged portion thereof advances to the exposure device. The exposure device includes a raster output scanner (ROS) 28, which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the highlight toner image has been developed on the exterior surface of photoconductive belt 10, photoconductive belt 10 continues to advance in the direction of arrow 14 to image recording station 18.

Image recording station 18 includes a recharging device and an exposure device. The charging device includes a corona generator 32 which recharges the exterior surface of photoconductive belt 10 to a relatively high, substantially uniform potential. The exposure device includes a ROS 34 which illuminates the charged portion of the exterior surface of photoconductive belt 10 selectively to record a second electrostatic latent image thereon. This second electrostatic latent image corresponds to the regions to be developed with magenta toner particles. This second electrostatic latent image is now advanced to the next successive developer unit 36.

Developer unit 36 deposits magenta toner particles on the electrostatic latent image. In this way, a magenta toner powder image is formed on the exterior surface of photoconductive belt 10. After the magenta toner powder image has been developed on the exterior surface of photoconductive belt 10, photoconductive belt 10 continues to advance in the direction of arrow 14 to image recording station 20.

Image recording station 20 includes a charging device and an exposure device. The charging device includes corona generator 38, which recharges the photoconductive surface to a relatively high, substantially uniform potential. The exposure device includes ROS 40 which illuminates the charged portion of the exterior surface of photoconductive belt 10 to selectively dissipate the charge thereon to record a third electrostatic latent image corresponding to the regions to be developed with yellow toner particles. This third electrostatic latent image is now advanced to the next successive developer unit 42.

Developer unit 42 deposits yellow toner particles on the exterior surface of photoconductive belt 10 to form a yellow toner powder image thereon. After the third electrostatic latent image has been developed with yellow toner, photoconductive belt 10 advances in the direction of arrow 14 to the next image recording station 22.

Image recording station 22 includes a charging device and an exposure device. The charging device includes a corona generator 44, which charges the exterior surface of photoconductive belt 10 to a relatively high, substantially uniform potential. The exposure device includes ROS 46, which illuminates the charged portion of the exterior surface of photoconductive belt 10 to selectively dissipate the charge on the exterior surface of photoconductive belt 10 to record a fourth electrostatic latent image for development with cyan toner particles. After the fourth electrostatic latent image is recorded on the exterior surface of photoconductive belt 10, photoconductive belt 10 advances this electrostatic latent image to the cyan developer unit 48.

Developer unit 48 deposits cyan toner particles on the fourth electrostatic latent image. These toner particles may be partially in superimposed registration with the previously formed yellow powder image. After the cyan toner powder image is formed on the exterior surface of photoconductive belt 10, photoconductive belt 10 advances to the next image recording station 24.

Image recording station 24 includes a charging device and an exposure device. The charging device includes corona generator 50 which charges the exterior surface of photoconductive belt 10 to a relatively high, substantially uniform potential. The exposure device includes ROS 52, which illuminates the charged portion of the exterior surface of photoconductive belt 10 to selectively discharge those portions of the charged exterior surface of photoconductive belt 10 which are to be developed with black toner particles. The fifth electrostatic latent image, to be developed with black toner particles, is advanced to black developer unit 54.

At black developer unit 54, black toner particles are deposited on the exterior surface of photoconductive belt 10. These black toner particles form a black toner powder image which may be partially or totally in superimposed registration with the previously formed yellow, magenta, and cyan toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

All xerographic subsystems are environmentally maintained inside the xero cavity. Air from and to the xero cavity is conditioned/filtered to predefined set points by using a special design environmental unit 510.

At transfer station 56, a receiving medium, i.e., paper, is advanced from stack 58 by sheet feeders and guided to transfer station 56. At transfer station 56, a corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper is stripped from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

Environmental conditioning unit 510 maintains the printing machine components enclosed in enclosure 500 at a predefined temperature and humidity. The Environmental Unit (EU) is an air conditioning unit with dual air flow discharge to provide cooling, heating and dehumidification to the xerographic enclosure/developer housings of the Xerox Print Engine. The EU provides the Print Engine precise control of temperature and humidity to assure stability of the PE advanced technologies so as to produce a new industry benchmark in image quality and productivity.

Figure 2:
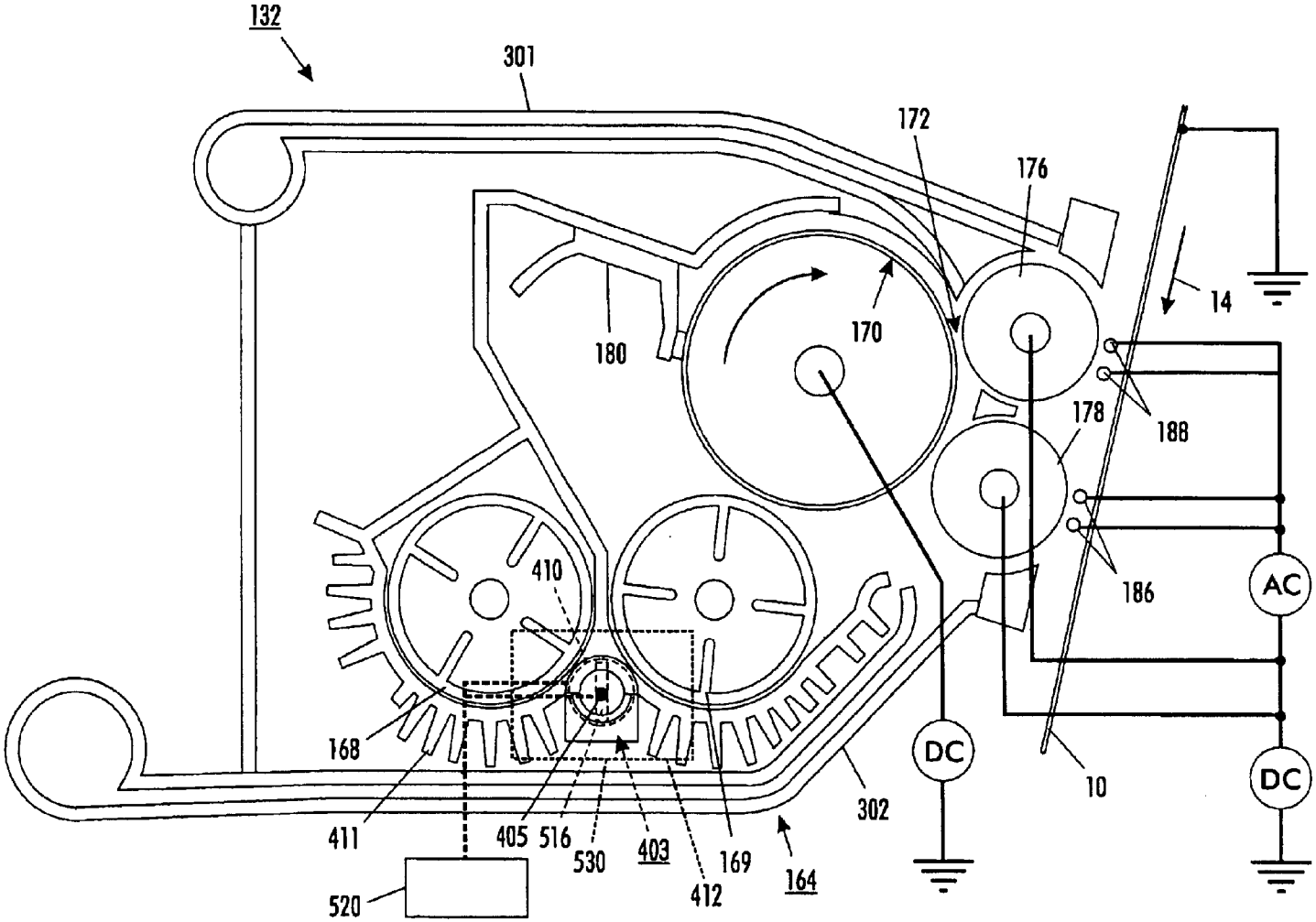
FIG. 2 is a developer system employing the present invention.

Referring now to FIG. 2, there are shown the details of a development apparatus 132. The apparatus comprises a reservoir or developing housing 164 containing developer material. The developer material is of the two component type, that is it comprises carrier granules and toner particles. The reservoir 164 includes augers 168, which are rotatably-mounted in the reservoir chamber. The augers 168 serve to transport and to agitate the developer material within the reservoir 164 and encourage the toner particles to adhere triboelectrically to the carrier granules. A magnetic brush roll 170 transports developer material from the reservoir 164 to loading nips of two donor rolls or members 176 and 178. Magnetic brush rolls are well known, so the construction of magnetic brush roll 170 need not be described in great detail. Briefly the magnetic brush roll 170 comprises a rotatable tubular housing within which is located a stationary magnetic cylinder having a plurality of magnetic poles impressed around its surface. The carrier granules of the developer material are permeable, as the tubular housing of the magnetic brush roll 170 rotates, the granules (with toner particles adhering triboelectrically thereto) are attracted to the magnetic brush roll 170 and are conveyed to the donor roll loading nips. A trim bar 180 removes excess developer material from the magnetic brush roll 170 and ensures an even depth of coverage with developer material before arrival at the first donor roll loading nip 172. At each of the donor roll loading nips, toner particles are transferred from the magnetic brush roll 170 to the respective donor rolls 176 and 178.

Each donor rolls 176 and 178 transports the toner to a respective development zone through which the photoconductive belt 10 passes. Transfer of toner from the magnetic brush roll 170 to the donor rolls 176 and 178 can be encouraged by, for example, the application of a suitable D.C. electrical bias to the magnetic brush roll 170 and/or donor rolls 176 and 178. The D.C. bias (for example, approximately 100 v applied to the magnetic brush roll 170) establishes an electrostatic field between the magnetic brush roll 170 and donor rolls 176 and 178, which causes toner particles to be attracted to the donor rolls 176 and 178 from the carrier granules on the magnetic brush roll 170.

The carrier granules and any toner particles that remain on the magnetic brush roll 170 are returned to the reservoir 164 as the magnetic brush roll 170 continues to rotate. The relative amounts of toner transferred from the magnetic brush roll 170 to the donor rolls 176 and 178 can be adjusted, for example by: applying different bias voltages to the donor rolls 176 and 178 adjusting the magnetic brush roll to donor roll spacing; adjusting the strength and shape of the magnetic field at the loading nips and/or adjusting the speeds of the donor rolls 176 and 178.

At each of the development zones, toner is transferred from the respective donor rolls 176 and 178 to the latent image on the photoconductive belt 10 to form a toner powder image on the latter. Various methods of achieving an adequate transfer of toner from a donor roll to a photoconductive surface are known and any of those may be employed at the development zones.

In FIG. 2, each of the development zones is shown as having the form i.e. electrode wires 186 and 188 are disposed in the space between each donor rolls 176 and 178 and photoconductive belt 10. FIG. 2 shows, for each donor rolls 176 and 178 a respective pair of electrode wires 186 and 188 extending in a direction substantially parallel to the longitudinal axis of the donor rolls 176 and 178. The electrode wires 186 and 188 are made from thin (i.e. 50 to 100 .mu. diameter) tungsten wires which are closely spaced from the respective donor rolls 176 and 178. The distance between each pair of electrode wires 186 and 188 and the respective donor rolls 176 and 178 is within the range from about 10 .mu. to about 40 .mu. (typically approximately 25 .mu.) or the thickness of the toner layer on the donor rolls 176 and 178. The electrode wires 186 and 188 are self-spaced from the donor rolls 176 and 178 by the thickness of the toner on the donor rolls 176 and 178. To this end the extremities of the electrode wires 186 and 188 are supported by the tops of end bearing blocks that also support the donor rolls 176 and 178 for rotation. The electrode wires 186 and 188 extremities are attached so that they are slightly below a tangent to the surface, including the toner layer, of the donor rolls 176 and 178. An alternating electrical bias is applied to the electrode wires 186 and 188 by an AC voltage source.

The applied AC establishes an alternating electrostatic field between each pair of electrode wires 186 and 188 and the respective donor rolls 176 and 178, which is effective in detaching toner from the surface of the donor rolls 176 and 178 and forming a toner cloud about the electrode wires 186 and 188, the height of the cloud being such as not to be substantially in contact with the photoconductive belt 10. The magnitude of the AC voltage is relatively low, for example in the order of 200 to 500 volts peak a frequency ranging from about 3 kHz to about 10 kHz. A DC bias supply (not shown) applied to each donor rolls 176 and 178 establishes electrostatic fields between the photoconductive belt 10 and donor rolls 176 and 178 for attracting the detached toner particles from the clouds surrounding the electrode wires 186 and 188 to the latent image recorded on the photoconductive surface of the photoconductive belt 10. At a spacing ranging from about 10 .mu. to about 40 .mu. between the electrode wires 186 and 188 and donor rolls 176 and 178, an applied voltage of 200 to 500 volts produces a relatively large electrostatic field without risk of air breakdown.

After development, toner may be stripped from the donor rolls 176 and 178 by respective cleaning blades (not shown) so that magnetic brush roll 170 meters fresh toner to clean donor rolls 176 and 178. As successive electrostatic latent images are developed, the toner particles within the developer material are depleted. A toner dispenser (not shown) stores a supply of toner particles. The toner dispenser is in communication with reservoir 164 and, as the concentration of toner particles in the developer material is decreased, fresh toner particles are furnished to the developer material in the reservoir 164. The augers 168 in the reservoir chamber mix the fresh toner particles with the remaining developer material so that the resultant developer material therein is substantially uniform with the concentration of toner particles being optimized. In this way, a substantially constant amount of toner particles is in the reservoir 164 with the toner particles having a constant charge.

In the arrangement shown in FIG. 2, the donor rolls 176 and 178 and the magnetic brush roll 170 can be rotated either "with" or "against" the direction of motion of the photoconductive belt 10. The two-component developer used in the apparatus of FIG. 2 may be of any suitable type. However, the use of an electrically conductive developer is preferred because it eliminates the possibility of charge build-up within the developer material on the magnetic brush roll 170 which, in turn, could adversely affect development at the second donor roll 178. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

The developer housing employs a system to control toner emission which is composed of two manifolds 301 and 302. The location of the two manifolds are placed above and below the upper and lower donor rolls respectively. The manifolds are mounted in a position to improve emissions control as well as reductions in the flow needed to accomplish the task.

The present invention includes a climate system, associated with the reservoir 164, for maintaining the supply of developer material at a predefined temperature, the climate system includes a heating element 405 and a cooling element 403 which supplies air between 50 to 60 F. from the environmental control system 510 to housing cooling channel 410. The air cools contacts thermal fins 411 which are integrated into housing to improve cooling of the housing when required. Preferably heating element 405 is positioned between augers 168 and 169. This allows even heating developer material in the housing while the developer mixed and transported within the housing.

Figure 5:
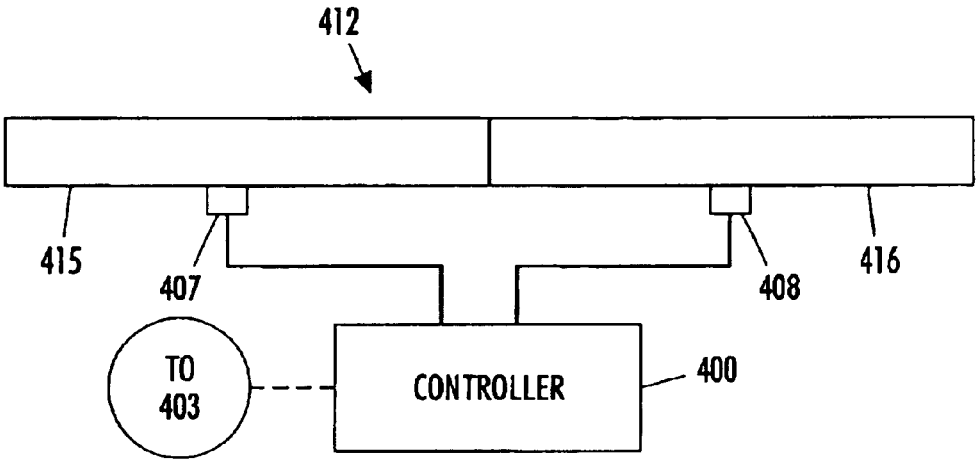
FIG. 5 illustrates the heating unit employed in FIG. 2.

Heating element 405 is composed of a dual heat rod assembly 412 to improve print quality stability by mitigating tribo variations that arise due to temperature excursions as shown in FIG. 5. The assembly is positioned within the air cooling channel around the outer walls of the development housing.

Applicants have found through simulations and experiments that controlling the material temperature between the required 80 to 90 degrees F. is desirable. Dual heat rod assembly 412 includes two heating units 415 and 416 that lie end to end to each other as shown in FIG. 5. Applicant has also found that this is a preferred because power levels to the heating elements can be maintained within a desirable range while maintaining an even temperature gradient along the housing. The climate system further includes a sensor 407 and sensor 408 associated with each heating units 415 and 416 for sensing the temperature of the supply of developer material in an inboard position and an outboard position. The climate system further includes a controller 400 in communication with the heating unit 415 and 416, the cooling element 403, and sensor 407 and 408. The controller 400 selectively and independently activating and de-activating the heating units 415 and 416 and/or the cooling element 403, based on the temperatures sensed by sensor 407 and 408 to maintain a constant predefined inboard and outboard temperature.

Applicants have found that developer material stability, for optimum performance, is based on several variables. Among these variables are relative humidity and temperature. The present invention centers primarily on temperature control. Applicants have found that the present invention provides a stable and repeatable development range for the developer material in printing machines, preferably a nominal temperature set point is defined plus and minus five degrees. Many factors affect this set point. Some include that the environmental control unit 510 that maintains an internal machine temperature that is less than what is optimum. Material friction, internal to a running developer housing, which drives the temperature higher. The present invention provides an efficient warming source to maintain an optimum standby temperature and a cooling source for materials in a developer run mode. In addition, controlling the temperature set point by external means provides an opportunity to effect the relative humidity of the material and it stability.

Figure 4:
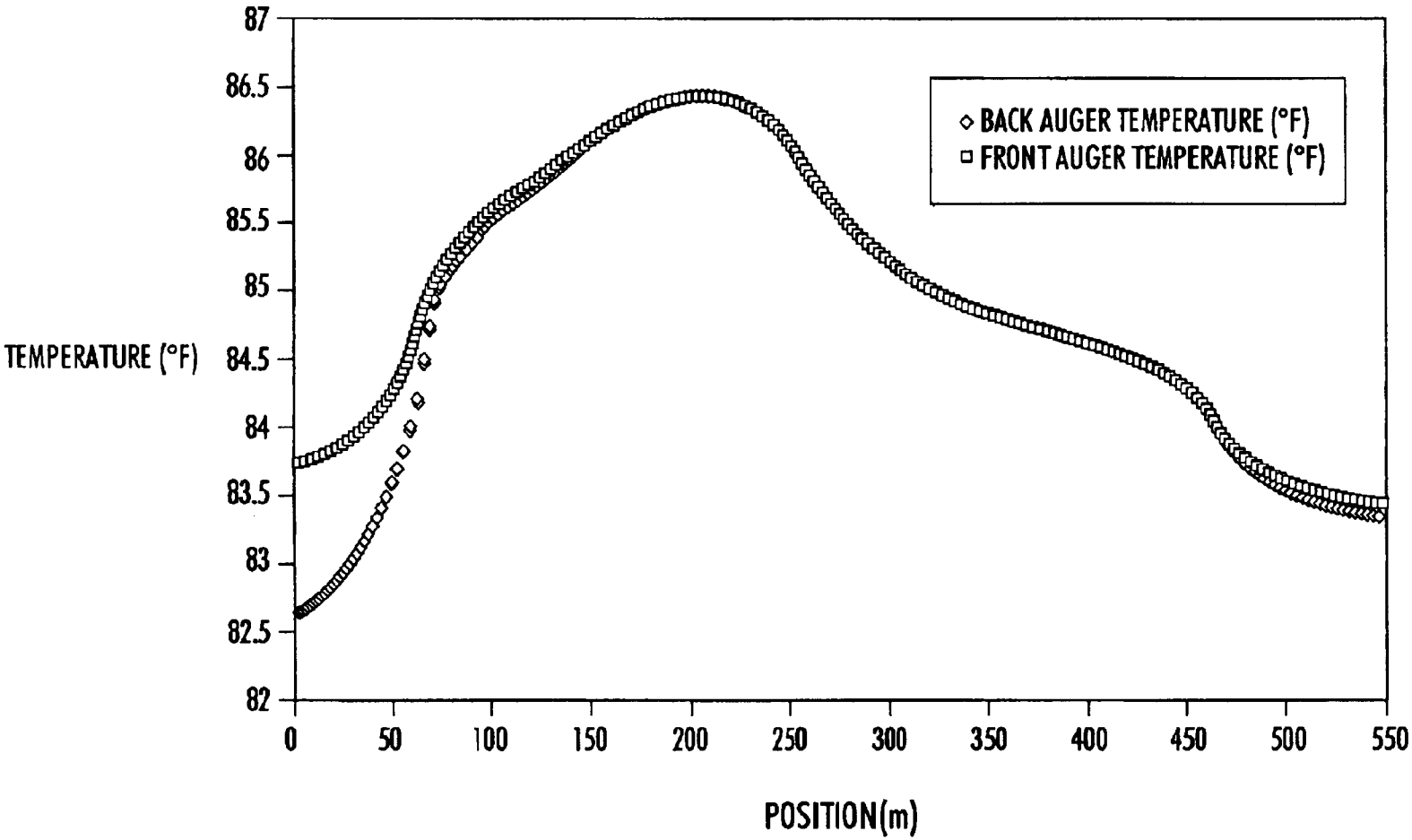
FIG. 4 is experimental data.

FIG. 4 shows the temperature gradient along the housing for several power dissipation levels. The power level combination of 60W/25 W provides a maximum temperature difference of 4° F., which is within the desired range. Furthermore, the absolute temperature distribution is within 80 to 90° F., with an average of about 86° F. These results is also within the desired range. Finally, neither one of the power dissipation levels required exceed the maximum available 70 Watts.

Figure 3:
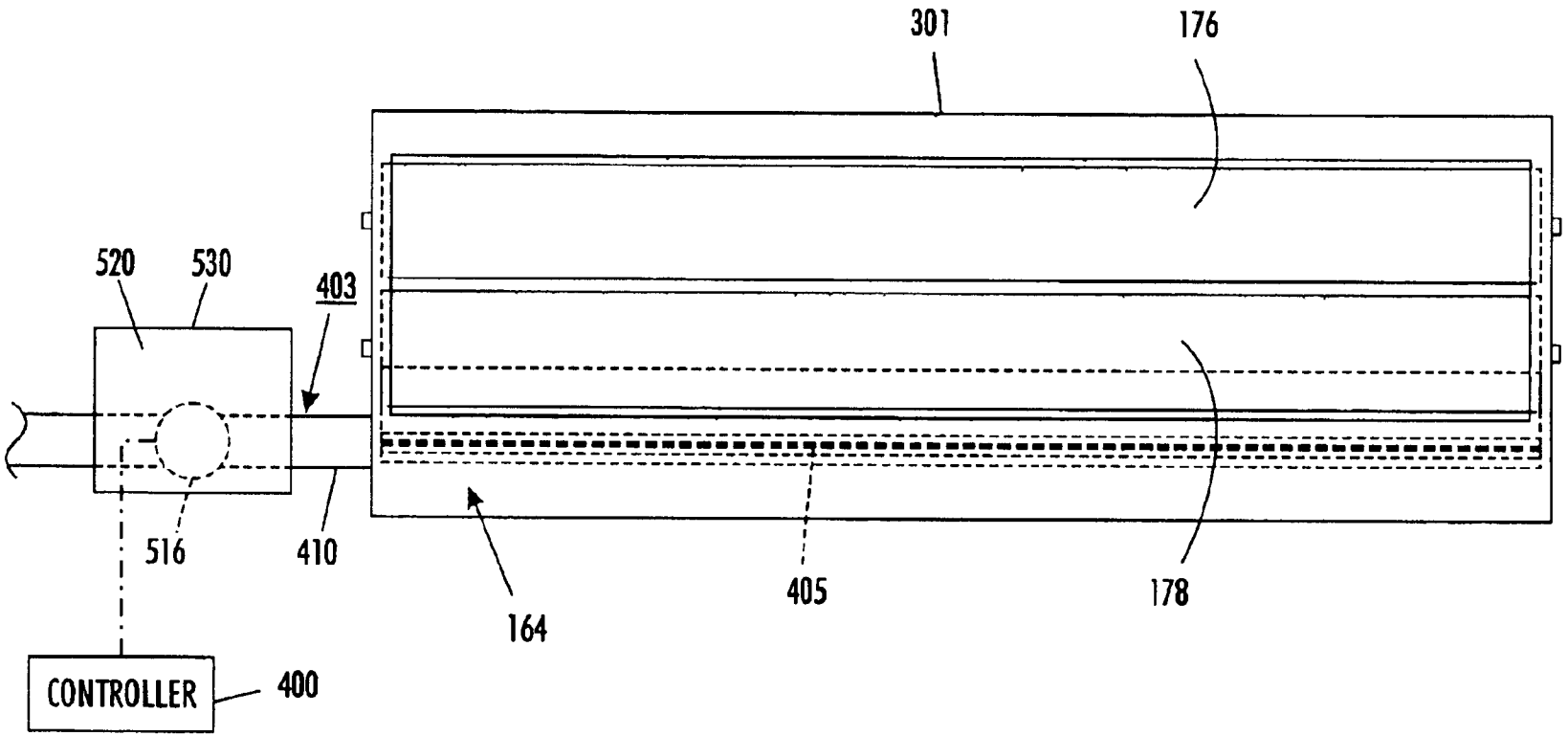
FIG. 3 is another embodiment of the present invention.

Now referring to FIG. 3, another embodiment consists of a ceramic heating element 516, a temperature controller 520 which includes, two mechanical relays (not shown), two solid state relays (not shown), and an enclosure 530. Air enters from environment control system 510 via a cooling channel 410 passes through the ceramic heater 516, and exits the enclosure through a flexible hose connected to the developer housing.

Upon entering stand by mode, a signal is sent to the auxiliary heater. Using this signal, the auxiliary ceramic heater 516 is turned on. The heating element quickly comes up to temperature, and raises the airflow temperature from approximately 45° F. to 75° F. Once the machine exits standby mode, the signal returns high, thereby shutting down the auxiliary heater.

Due to safety concerns, several redundant safety mechanisms were designed into the heater. If airflow is shut off, a pressure switch set to 1 inch of water is triggered, and power is disrupted to the heating element 516. Likewise, if the cover to the enclosure is removed, a safety interlock switch (not shown) is activated, and power is disrupted to the heating element 516. For service while power is connected, there is a master power switch which can be manually activated. If the temperature controller 520 sees a break in the thermocouple circuit, it fails safe, and shuts down the heating element. Lastly, if all else fails, and the heating element continues to heat, there is a thermal fuse to interrupt power once the heater reaches a certain temperature.

The enclosure that houses the electronics is a plated steel box, with a removable lid. The entire box, including mounting brackets, is insulated with ⅛" insulation foam to prevent condensation from forming on the outside of the box.

It is, therefore, apparent that there has been provided in accordance with the present invention which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing a latent image recorded on a movable imaging surface, including:

a reservoir for storing a supply of developer material including toner particles, said reservoir including a developer material mixing and transport area;

a donor member being arranged to receive toner particles from said reservoir and to deliver toner particles to the image surface at locations spaced apart from each other in the direction of movement of the imaging surface thereby to develop the latent image thereon; and a climate system, associated with said reservoir, for maintaining said supply of developer material at a predefined temperature, said climate system includes a cooling element for supplying air to said developer material mixing and transport area, and a heating element positioned in said developer material mixing and transport area, said heating element includes a first heat unit associated with heating an inboard area of said developer material mixing and transport area and a second heat unit associated with heating an outboard area of said developer material mixing and transport area.

2. The apparatus of claim 1, wherein said climate system further includes sensors for sensing the temperature of said supply of developer material in an inboard and an outboard position of said developer material mixing and transport area.

3. The apparatus of claim 2, wherein said climate system further includes a controller in communication with said first and second heating units, said cooling element and said sensors, said controller selectively activating and de-activating said heating element, said cooling element based on the temperature sensed by said sensor.

4. The apparatus of claim 2, wherein said heating element is heat sink to an outer portion of said reservoir associated with developer material mixing and transport area.

5. The apparatus of claim 4, wherein said outer portion of said reservoir includes cooling/heating fins for improving heat transfer.

6. The apparatus of claim 1, further comprising a first mode of operation wherein said cooling element cools said reservoir to a first predefined temperature during a print job.

7. The apparatus of claim 1, further comprising a second mode of operation wherein said heat element heats said reservoir to a second predefined temperature during a standby mode.

8. The apparatus of claim 1, wherein said cooling element supply air to a cooling channel defined in said reservoir.

9. An xerographic printer including an environmental enclosure having xerographic stations enclosed therein selected from the group of: an imaging member, imaging station for recording an image on the imaging member, a development station for developing station for developing the image on the imaging member, and a transfer station for transferring the developed image to a substrate, comprising:

an environmental climate unit connected to the environmental enclosure for maintaining xerographic stations therein at a predefined temperature; and wherein said development station includes:

a reservoir for storing a supply of developer material including toner particles, said reservoir including a developer material mixing and transport area;

a donor member being arranged to receive toner particles from said reservoir and to deliver toner particles to the image surface at locations spaced apart from each other in the direction of movement of the imaging surface thereby to develop the latent image thereon; and a climate system, associated with said reservoir, for maintaining said supply of developer material at a second predefined temperature, said climate system includes a cooling element for supplying air to said developer material mixing and transport area, and a heating element positioned in said developer material mixing and transport area, said heating element includes a first heat unit associated with heating an inboard area of said developer material mixing and transport area and a second heat unit associated with heating an outboard area of said developer material mixing and transport area.

10. The xerographic printer of claim 9, wherein said climate system further includes sensors for sensing the temperature of said supply of developer material in an inboard and an outboard position of said developer material mixing and transport area.

11. The xerographic printer of claim 10, wherein said climate system further includes a controller in communication with said first and second heating units, said cooling element and said sensors, said controller selectively activating and de-activating said heating element, said cooling element based on the temperature sensed by said sensor.

12. The xerographic printer of claim 10, wherein said heating element is heat sink to an outer portion of said reservoir associated with developer material mixing and transport area.

13. The xerographic printer of claim 9, further comprising a first mode of operation wherein said cooling element cools said reservoir to a first predefined temperature during a print job.

14. The xerographic printer of claim 9, further comprising a second mode of operation wherein said heat element heats said reservoir to a second predefined temperature during a standby mode.

15. The xerographic printer of claim 14, wherein said outer portion of said reservoir includes cooling/heating fins for improving heat transfer.

16. The xerographic printer of claim 9, wherein said cooling element supply air to a cooling channel defined in said reservoir.

* * * * *